United States Patent [19]

Ivarsson

[11] 4,305,431

[45] Dec. 15, 1981

[54] SYSTEM AND A TYING UP STRING FOR TYING UP A HAND LOOM

[76] Inventor: Sune Ivarsson, Alehemsvägen 18, Älvängen, Sweden, 44600

[21] Appl. No.: 177,743

[22] PCT Filed: May 17, 1979

[86] PCT No.: PCT/SE79/00109

§ 371 Date: Jan. 23, 1980

§ 102(e) Date: Dec. 31, 1979

[87] PCT Pub. No.: WO79/01102

PCT Pub. Date: Dec. 13, 1979

[30] Foreign Application Priority Data

May 23, 1978 [SE] Sweden ..... 7805843

[51] Int. Cl.[3] ..... D03D 29/00

[52] U.S. Cl. ..... 139/29; 139/88

[58] Field of Search ..... 139/29, 30, 32, 33, 139/87, 88 R, 84, 82

[56] References Cited

U.S. PATENT DOCUMENTS

| | | | |
|---|---|---|---|
| 228,191 | 6/1880 | Halcroft | 139/82 |
| 498,474 | 5/1893 | Johnson | 139/88 |
| 1,668,124 | 5/1928 | Pfeiffer . | |
| 1,803,539 | 5/1931 | Stone | 139/88 |
| 1,901,250 | 3/1933 | Mattler | 139/29 |

FOREIGN PATENT DOCUMENTS

| | | | |
|---|---|---|---|
| 645151 | 5/1937 | Fed. Rep. of Germany . | |
| 646979 | 6/1937 | Fed. Rep. of Germany . | |
| 737437 | 12/1932 | France . | |
| 814492 | 3/1937 | France | 139/88 |
| 90951 | 1/1946 | France | 139/84 |
| 401936 | 6/1978 | Sweden . | |
| 266071 | 4/1950 | Switzerland . | |

*Primary Examiner*—Henry Jaudon

*Attorney, Agent, or Firm*—Holman & Stern

[57] ABSTRACT

In hand looms a plurality of moveable parts of the loom are interconnected by means of the different loom parts.

An improved attachment of tying up strings wherein the tying up string consists of a crochetted string shaped as a continuous series of loops, which are used for effecting the interconnection of said loom parts either alone, in pairs, and/or with or without separate fitting members thereby eliminating manual tying work.

6 Claims, 7 Drawing Figures

SYSTEM AND A TYING UP STRING FOR TYING UP A HAND LOOM

BRIEF SUMMARY OF THE INVENTION

Conventional hand looms are provided with a plurality of strings or threads, which are used for tying up the loom. These strings extend e.g. between treadles and lambs, between lambs and shafts, and from one shaft via a pulley to another shaft etc. These strings are generally attached to their different attachment points by being slipped through holes in their associated parts and thereafter being manually provided with knots. Due to the fact that a large number of strings must be provided with knots in accurate positions in order to set up the loom correctly and as these knots must often be made in uncomfortable and difficult working postures—particularly for tying up lambs and treadles which often must be made person crawling into the loom and sitting down adjacent the treadles—the tying up is an extensive and uncomfortable manual work. These strings are furthermore during weaving subjected to considerable wear, whereby the strings after a comparatively short service will burst and must be replaced, which means repeated work. In order to increase the lifespan of the tying up it has in later years been tried to use synthetic string material which has a considerably larger strength than the traditional textile strings. These synthetic strings have from wear aspects been superior to the textile strings but it has instead been difficult to make reliable knots thereon as the more slippery material means that the knots have a tendency of "sliding" and to become untied when exposed to stresses.

The purpose of the present invention is to provide a tying up system by aid of which the difficulties and drawbacks mentioned hereabove are eliminated and this is obtained by using tying up strings, which consist of a continuous series of loops each two adjacent loops of which are separated from each other by a short interconnecting rib, said tying up strings being adapted to be fixed to the associated loom component by fitting at least one of said loops to said loom component at any conventional position along the length of the tying up string with or without use of separate fitting members thus eliminating the conventional manual tying work.

The invention also includes a tying up string intended to be used in the system according to the invention and this string is characterized in that it consists of at least two crochetted threads, which are brought alongside each other and are interconnected by crochetting in such a manner that it consists of a continuous series of loops, each two adjacent loops of which are separated by a short interconnecting rib.

DESCRIPTION OF THE DRAWINGS

The invention will hereinafter be further described with reference to some embodiments shown in the several views of the accompanying drawings.

DETAILED DESCRIPTION

Figure 1:
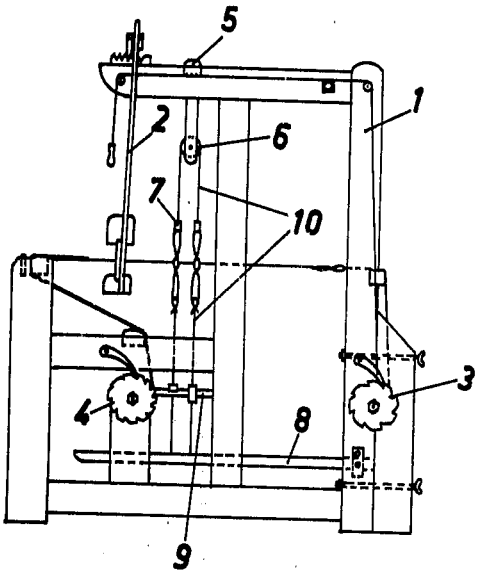
FIG. 1 shows in a schematic side elevation a hand loom.
Figure 2:
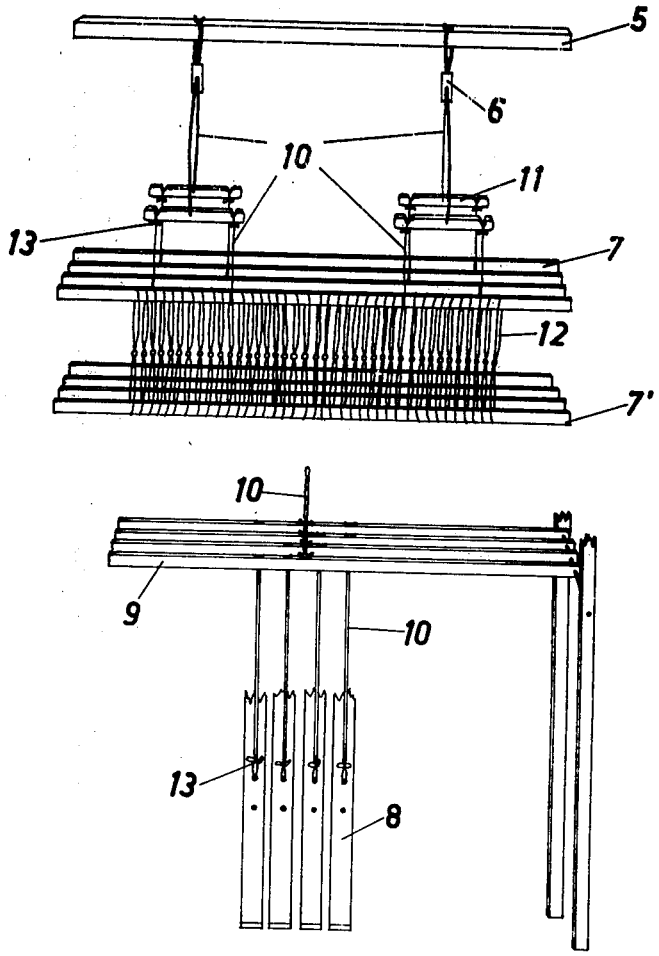
FIG. 2 is a fragmentary view showing the conventional tying up of the shafts, lambs and treadles of the loom.

FIGS. 1 and 2 show in a schematic side view and a fragmentary frontal view respectively a hand loom and its conventional tying up system.

The loom includes a stand 1 which carries a sley 2, a warp beam 3 and a cloth beam 4. The stand furthermore carries the heald 5, which carries pulleys 6, which—commonly via shaft carriers 11 (see FIG. 2)—via tying up strings 10 carry the shafts 7, 7', which form the suspension for the healds 12. The movement of the shafts is controlled by treadles 8, which by aid of tying up strings 10—commonly via lambs 9—are connected to the lower shaft 7'.

In FIG. 2 is shown the connections between the tying up strings and the different loom components—such as heald bar 5, shaft carriers 11, shafts 7, 7', lambs 9 and treadles 8—to which these strings are connected in conventional manner by means of manually tied knots 13, which therefore on one hand has a tendency of sliding and on the other hand means extensive manual work when setting up the hand loom.

Figure 3:
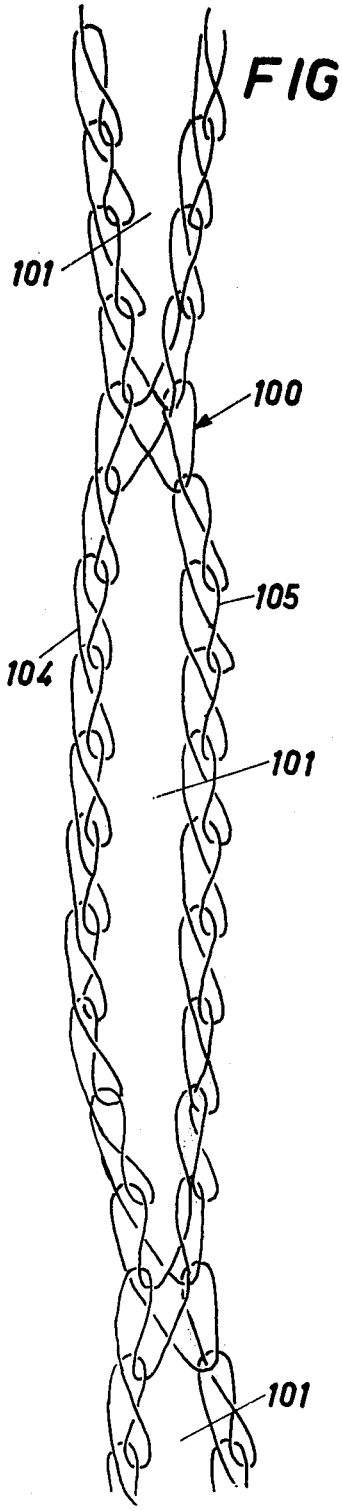
FIG. 3 is a schematic view of a tying up string according to the invention.

In FIG. 3 is schematically shown in exaggerated scale a tying up string of the type included in the invention and which is the most vital part of the system according to the invention.

As can be seen in this figure the string 100 consists of two threads 104, 105 which are brought along—side each other and which—preferably in a hosiery machine—have been crochetted together in such a manner that they form a single series of loops 101, which are separated—and interconnected by means of intermediate short "ribs". In the figure is shown only one complete loop 101 but it is to be understood that the string forms a continuous series of essentially similar and equally large loops 101.

Figure 4:
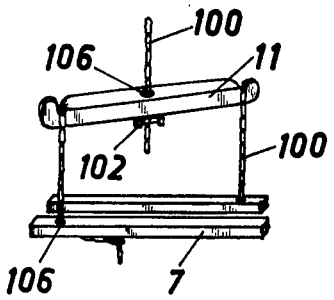
FIG. 4 shows in a schematic side elevation in perspective tying up of a shaft stick to a shaft carrier by means of different fitting details of the system according to the invention.

FIG. 4 shows schematically in perspective the tying up between a shaft carrier 11 and upper shafts 7 and the figure shows different methods of attachment. The shaft carrier 11 is connected to a not shown pulley via a centrally located tying up string 100 which extends through a hole 106 in the shaft carrier. A fitting member formed as a stop element 102 is inserted through the loop situated nearest to the shaft carrier on the side thereof opposite the pulley and this stop element is larger than the hole 106 and it will thereby prevent the tying up string from being pulled back through the hole.

Figure 5:
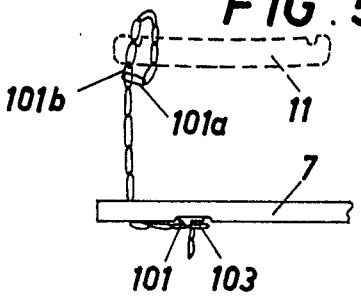
FIG. 5 is a detail from FIG. 4 shown in elucidated fashion.

At both ends of the shaft carrier there are attached other tying up strings 100 which are connected to the shafts 7. The strings are at the ends of the shaft carrier preferably attached thereto as shown in FIG. 5 wherein the series of loops **101*b* is slipped through the outmost loop 101*a* of the string, forming a running noose, which can be arranged about the end of the shaft carrier in the groove therein. The tying up string 100 is furthermore attached to the bottom side of the upper shaft 7 by being slipped through a hole 106 and fixed to the shaft by having a loop 101 hooked to a hooking member 103**.

Figure 6:
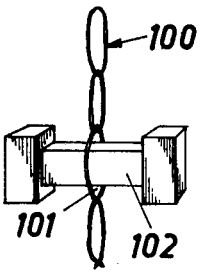
FIG. 6 is an embodiment of a stop of the type incorporated in the system according to the invention.

In FIG. 6 is shown in bigger scale a stop element 102 of the type shown in FIG. 4. This stop element is designed essentially as a "dog's bone" i.e. it incorporates a rod shaped intermediate portion having a cross-sectional size which is less than the opening of a loop 101. At the ends of the rod shaped member there are provided enlarged material portions the cross sectional side of which is bigger than the intermediate portion and essentially equal to or even somewhat bigger than the opening of the loop. It is hereby possible to insert the stop element in any desired loop by pressing it into the loop possibly under use of the flexibility of the thread for stretching the loop during the inserting of the stop element. When the stop element has been put in place it will efficiently prevent the string from unintentionally being pulled out of the hole 106 and as the force in the string will be mainly perpendicular to the longitudinal direction of the stop element the stop element will not be pulled out of the loop.

Figure 7:
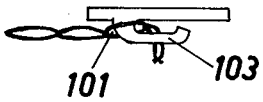
FIG. 7 shows an embodiment of a hook member of a type which also forms part of the tying up system of the invention.

In FIG. 7 is shown an embodiment of a hook member 103 of the type intimated in FIG. 5. The hook member comprises a base member which can be fixed to the loom component, to which the tying up string in question shall be attached. On the base member there is arranged a hook, which preferably is somewhat elastic and intended to be hooked by a loop 101. By using a suitable design of the hook member together with the fact that the string in its service position is subjected to a pulling force acting in the direction away from the hook member 103 the tying up string will be reliably retained against undesired unhooking from the hooking member.

In this manner it is very easy to attach the tying up strings exactly in their desired positions without the problems which are usual at hand tying. It is also easy to unhook the connections when this is desired e.g. for replacement of worn out strings. According to the system of the invention the entire tying up work will thus be simplified and reduced to a considerable extent.

The material in the tying up string 100 is a wear-resistant, somewhat flexible, preferably synthetic material. It is of no importance if this material is slippery as there can exist no sliding in the crochetted loops, whereby the sliding problems usual at the synthetic tying up strings provided with hand-tied knots are entirely eliminated.

The invention has been described in connection with the most essential tying up operations, which will arise at a hand loom but it is to be understood that other tying up cases present at hand looms or the like can be favourably incorporated in the system according to the invention.

It is of course furthermore evident that the invention is not limited to the part solutions shown in the accompanying drawings and described with reference thereto but modifications are possible within the scope of the appended claims.

I claim:

1. A system for tying up a hand loom wherein movable components of the loom are interconnected by tying up strings comprising said tying up strings being formed of at least two threads which are stitched together to form a continuous series of loops of strings each two adjacent loops of which are separated from each other by a short, interconnecting rib, and being adapted to be fixed to their associated loom component by fitting said loom component into at least one of said loops at any convenient position along the length of said tying up string.

2. The system claimed in claim 1, wherein holes for the tying up strings are provided in said loom components and a tying up string extends through each said hole from one side thereof to its other side, and further comprising a fitting member formed as a stop element is threaded through the loop of each tying up string situated nearest to said loom component on said other side, said stop element having such size and shape as to prevent the tying up string from being pulled back through said hole when fitted in a loop.

3. The system claimed in claim 2, wherein said stop element is rod shaped and has enlarged end portions, which have such a size as compared to the loops, that said loops must be stretched out somewhat to be able to pass over said end portions.

4. The system claimed in claim 1 wherein holes for the tying up strings are provided in said loom components and a tying up string extends through each hole from one side thereof to the other side thereof, and further comprising fitting members formed as hook members attached to said other side of the loom component and adapted to receive in hitching cooperation a loop situated adjacent thereto.

5. A system as claimed in claim 1, wherein said tying up string comprises at least two crochetted threads, which are brought alongside each other and interconnected by crochetting in such a manner to produce a continuous series of loops, each two adjacent loops of which are separated by a short interconnecting rib.

6. The tying up string claimed in claim 5, wherein its threads consist of a wear-resisting, somewhat resilient and preferably synthetic material.

* * * * *